US011940236B2

(12) United States Patent
Bolen et al.

(10) Patent No.: US 11,940,236 B2
(45) Date of Patent: Mar. 26, 2024

(54) STEALTH VEHICLE WITH INTEGRATED FAST DEPLOYMENT WEAPON SYSTEM

(71) Applicant: JOHN COCKERILL DEFENSE SA, Loncin (BE)

(72) Inventors: Philippe Bolen, Angleur (BE); Fabian Corona, Retinne (BE)

(73) Assignee: JOHN COCKERILL DEFENSE SA, Loncin (BE)

( * ) Notice: Subject to any disclaimer, the term of this patent is extended or adjusted under 35 U.S.C. 154(b) by 0 days.

(21) Appl. No.: 17/419,304

(22) PCT Filed: Feb. 7, 2020

(86) PCT No.: PCT/EP2020/053156
§ 371 (c)(1),
(2) Date: Jun. 29, 2021

(87) PCT Pub. No.: WO2020/169368
PCT Pub. Date: Aug. 27, 2020

(65) Prior Publication Data

US 2022/0074696 A1 Mar. 10, 2022

(30) Foreign Application Priority Data

Feb. 21, 2019 (EP) ..... 19158468

(51) Int. Cl.
*F41A 23/20* (2006.01)
*F41H 7/02* (2006.01)

(52) U.S. Cl.
CPC ..... *F41A 23/20* (2013.01); *F41H 7/02* (2013.01)

(58) Field of Classification Search
CPC ..... F41A 23/20; F41H 7/02
See application file for complete search history.

(56) References Cited

U.S. PATENT DOCUMENTS 1,093,504 A * 4/1914 Voller ..... F41A 23/22 114/320
2,559,714 A * 7/1951 Duplessis ..... F41A 23/24 89/33.14

(Continued)

FOREIGN PATENT DOCUMENTS

EP 0116159 A2 * 8/1984
EP 0411993 B1 7/1993

(Continued)

OTHER PUBLICATIONS

Dobrzynski et al. <https://sciendo.com/es/article/10.2478/sjpna-2018-0023>. Sep. 29, 2018. (Year: 2018).*

*Primary Examiner* — Gabriel J. Klein
(74) *Attorney, Agent, or Firm* — LEYDIG, VOIT & MAYER, LTD.

(57) ABSTRACT

An armored land vehicle includes: a roof delimited by an opening containing a recess; a retractable weapon system to be deployed automatically between a first retracted position located inside the vehicle in the recess of the roof and a second deployed and operational position located outside the vehicle; an automatic mechanism to ensure, during use, a movement of the weapon system between the first and second positions; and an armored cap secured to the weapon system to cover the recess by forming a junction between an outer contour of the cap and a periphery of the opening of the roof with a perfect fit and in an extension of the roof surface, when the weapon system is in the first position. The weapon system includes at least one weapon with a caliber of up to 40 mm. The opening containing the recess is fitted or related to weapon system dimensions.

6 Claims, 5 Drawing Sheets

(56) References Cited

U.S. PATENT DOCUMENTS

| | | | | | |
|---|---|---|---|---|---|
| 3,316,809 | A * | 5/1967 | Riedel | F41F 3/04 | 89/37.12 |
| 3,340,768 | A * | 9/1967 | Kindrot | F41F 3/0406 | 89/1.815 |
| 4,106,389 | A * | 8/1978 | Walley | F41F 3/06 | 89/1.816 |
| 4,282,794 | A * | 8/1981 | Miller | B62D 61/10 | 182/69.5 |
| 4,523,793 | A * | 6/1985 | Fritz | F41A 27/16 | 384/604 |
| 4,667,565 | A * | 5/1987 | Anderson | F41A 23/20 | 89/37.03 |
| 5,056,409 | A | 10/1991 | Allais et al. | | |
| 6,009,791 | A | 1/2000 | Medlin | | |
| 6,907,812 | B1 * | 6/2005 | Eckstedt | F41A 23/20 | 89/1.8 |
| 2005/0011348 | A1 * | 1/2005 | Bertrand | F41A 23/20 | 89/37.01 |
| 2005/0066806 | A1 * | 3/2005 | Helms | F41A 23/34 | 89/38 |
| 2010/0071540 | A1 * | 3/2010 | Cazalieres | F41A 23/20 | 89/41.01 |
| 2010/0282150 | A1 * | 11/2010 | Onuk | F41A 23/20 | 114/15 |
| 2014/0116234 | A1 * | 5/2014 | Jacq | F41G 5/06 | 89/1.11 |
| 2014/0150637 | A1 * | 6/2014 | Chiappini | F41H 5/16 | 89/36.13 |
| 2021/0276492 | A1 * | 9/2021 | Baumeier | B60R 5/00 | |

FOREIGN PATENT DOCUMENTS

| | | | |
|---|---|---|---|
| EP | 0612969 | B1 | 4/1997 |
| FR | 2390702 | A1 * | 12/1978 |
| FR | 2390702 | A1 | 12/1978 |
| GB | 1522042 | A | 8/1978 |

* cited by examiner

STEALTH VEHICLE WITH INTEGRATED FAST DEPLOYMENT WEAPON SYSTEM

CROSS-REFERENCE TO PRIOR APPLICATIONS

This application is a U.S. National Phase application under 35 U.S.C. § 371 of International Application No. PCT/EP2020/053156, filed on Feb. 7, 2020, and claims benefit to European Patent Application No. EP 19158468.9, filed on Feb. 21, 2019. The International Application was published in French on Aug. 27, 2020 as WO 2020/169368 under PCT Article 21(2).

FIELD

The present invention relates to the technological field of the integration of compact weapon systems, for example weapon systems of different calibers on a light (armored) vehicle, said calibers covering the range of small and medium calibers.

BACKGROUND

The present invention more specifically relates to a vehicle comprising a retractable weapon system, the weapon system being completely concealed in the roof of the vehicle when it is in the retracted position, and able to deploy quickly when it is put into operation.

In the context of the present invention, a stealth vehicle refers to a military vehicle capable of coming very close to the enemy without being spotted.

Retractable weapon systems are known arranged on military vehicles that have the property of being large and cumbersome systems, which do not allow fast commissioning.

Document U.S. Pat. No. 6,009,791 A discloses an armored vehicle comprising a mechanized retractable platform, on which a weapon is placed. The weapon is located inside the vehicle when the platform is in a lowered position and is located on top of the roof of the vehicle when the platform is in a raised position. This platform does not offer speed of implementation or compactness in its use and is not intended for small-caliber weapons.

Document U.S. Pat. No. 4,667,565 A discloses a fast antiterrorist intervention vehicle comprising an opening of the hatch type provided in the roof to deploy an automatic weapon, as well as a structure fastened to the floor of the vehicle with a pivoting frame. A weapon support ring is pivotably fastened to the pivoting frame such that the assembly is horizontal and positioned in the opening of the roof when the frame is pivoted toward the firing position. In this document, the weapon folding system is cumbersome and is not configured for small-caliber weapons.

Document EP 0,411,993 B1 discloses a light armored vehicle comprising a deployable mounting of the light anti-aircraft gun on its roof. The gun can thus be folded on the roof of the vehicle, but it is not camouflaged. The visible weapon also has the drawback of decreasing the aerodynamics, and requires the driver to limit the speed of the vehicle. Additionally, the shooter must be outside the passenger compartment in order to use the weapon.

Document EP 0,612,969 B1 discloses an all-terrain vehicle having an apparatus mounted on the cargo area and overhanging the driver's cab, in particular for anti-aircraft defense. The apparatus is positioned on a platform maintained on a frame solidly anchored to the cargo area so as to be able to pivot around a pivoting shaft extending transversely relative to the longitudinal axis of the vehicle, from an approximately horizontal usage position located substantially parallel to the loading area below the contour of the roof to an approximately vertical transport position extending along the rear wall of the driver's cab, and vice versa. Once again, this is a cumbersome and complex solution.

Document GB 1 522 042 A discloses a missile launching installation from an armored vehicle comprising an enclosure that can be maintained at a pressure higher than the external pressure, including a housing, at least one launching ramp mounted on a mobile support, means for moving the support between a firing position outside the housing and a retracted position in which the support and the (or each) ramp are inside the housing, the housing being provided with a first opening for the passage of the ramp through, the first opening being capable to be closed by a hatch in the retracted position of the support, and means for controlling the orientation of the mobile support in azimuth and in elevation, characterized in that the housing constitutes an assembly to be installed inside the vehicle enclosure with the first opening coplanar with an upper wall for the enclosure and with the mobile support substantially mobile vertically and in that it is provided with a second loading opening for communication with the interior of the enclosure and closable by a hatch, the hatches of the first and second openings being airtight so that the housing constitutes an airlock.

The company Carmor (Israel) markets a tactical armored combat vehicle, in the buggy style, called "Mantis"™ that has a weapon system on its roof platform that is retractable, but not camouflaged.

At this time, there are many applications to more or less heavy land vehicles of the 4×4, buggy, etc. type that have a weapon system that is visible and generally manually removable, for example of the remote weapon system (RWS) type. These systems make it possible to offer the shooter protection in the vehicle.

However, these weapon or turret systems, irrespective of whether they are remotely operated, aside from being visible, have the drawback of having a significant wind surface area and becoming dirty (sand) and not being able to be reloaded from the inside of the vehicle. Additionally, these systems contribute to raising the center of gravity of the vehicle and may optionally create an imbalance or loss of equilibrium of the assembly.

SUMMARY

In an embodiment, the present invention provides an armored land vehicle, comprising: a roof delimited by an opening containing a recess; a retractable weapon system configured to be deployed automatically between a first retracted position located inside the vehicle in the recess of the roof and a second deployed and operational position located outside the vehicle; an automatic mechanism configured to ensure, during use, a movement of the weapon system between the first and second positions; and an armored cap secured to the weapon system configured to cover the recess by forming a junction between an outer contour of the cap and a periphery of the opening of the roof with a perfect fit and in an extension of the roof surface, when the weapon system is in the first position, wherein the weapon system comprises at least one weapon with a caliber of up to 40 mm, and wherein the opening containing the recess is fitted or related to dimensions of the weapon system with the cap, the cap being adjusted to the dimensions of the weapon so as to have a smallest possible surface area.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
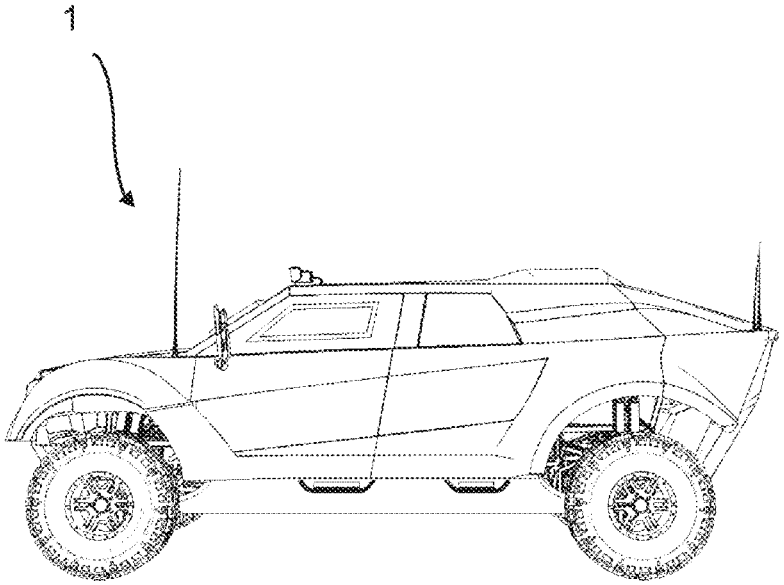
FIG. 1 schematically shows a profile view of the vehicle with the weapon system in the retracted position.
Figure 2:
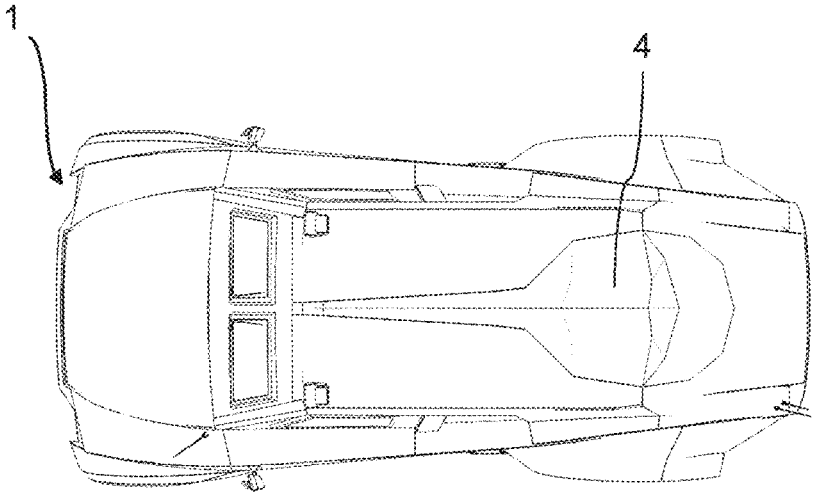
FIG. 2 schematically shows a top view of the vehicle with the weapon system in the retracted position.
Figure 3:
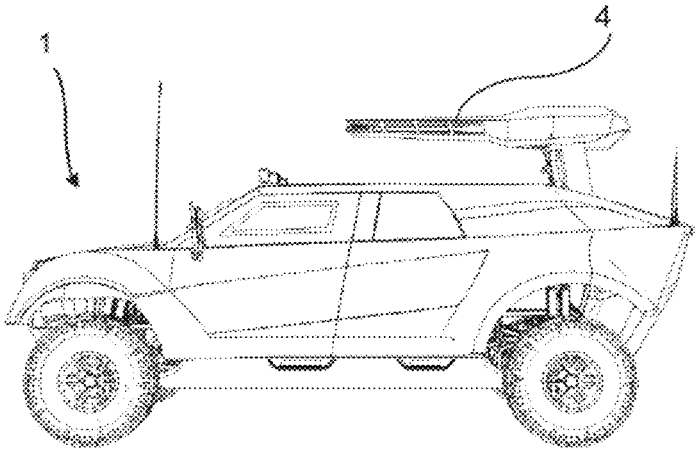
FIG. 3 schematically shows a profile view of the vehicle with the weapon system in the operational deployed position.

In an embodiment, the present invention addresses the drawbacks of the state of the art.

In an embodiment the present invention provides a vehicle with a retractable weapon system, the weapon system being completely hidden in the upper part of the shell of the vehicle when it is in the retracted position so that the weaponry is not visible for a person located outside the vehicle. The goal is for the vehicle then to be able to be confused with a standard vehicle optionally of the civilian type, and to retain optimal aerodynamics allowing it to have normal, or even high movement speeds.

Furthermore, in an embodiment the present invention produces a compact retractable weapon system, which can be reloaded through the inside of the vehicle such that no operation requires the crew to leave the vehicle.

In an embodiment the present invention allows quick and easy placement of the weapon system from the storage or resting position to the operational deployed position. The automated mechanism used must make it possible to be operational quickly, typically in less than 5 seconds.

In an embodiment the present invention produces a vehicle whose roof is tight with respect to the outside environment when the weapon system is folded in the passenger compartment.

In an embodiment the present invention avoids arranging a door, such as a roof hatch, in the roof of the vehicle for the deployment of a weapon, and therefore to preserve the integrity of the protection provided by the vehicle.

The present invention relates to an armored land vehicle comprising:

- a roof delimited by an opening containing a recess;
- a retractable weapon system able to be deployed automatically between a first retracted position located inside the vehicle in the recess of the roof and a second deployed and operational position located outside the vehicle;
- an automatic mechanism able to ensure, during use, the movement of the weapon system between the two aforementioned positions;
- an armored cap secured to the weapon system making it possible to cover the recess by forming a junction between an outer contour of said cap and the periphery of the opening of the roof with a perfect fit and in the extension of the roof surface (2), when the weapon system is in the first retracted position, characterized in that the weapon system (4) comprises at least one weapon with a caliber of up to 40 mm and in that the opening containing the recess (3) is fitted or related to the dimensions of the weapon system (4) with its cap (5), said cap (5) being adjusted to the dimensions of the weapon so as to have the smallest possible surface area.

According to specific embodiments of the invention, the vehicle further includes at least one of the following features, or any suitable combination thereof: the armored cap completely covers the recess in the upper part of the shell of the vehicle;

- the closing of the recess by the cap creates a tight space containing the weapon system, the tightness is ensured at the tight space by at least one seal;
- the cap covers only the upper part of the weapon system or constitutes a protective shell completely surrounding at least part of the weapon system;
- the automatic mechanism ensuring the movement of the weapon system during use comprises at least one jack;
- the vehicle also comprises an ammunition supply rail located below the recess of the roof of the vehicle so as to be able to supply the weapon system from inside the vehicle;
- the weapon system is installed on a weapon support, said weapon support being mounted pivotably with the weapon system by means of a rolling bearing;
- the weapon support is mounted pivoting by 360° about a vertical axis;
- the vehicle also comprises an inner hatch made below the recess of the roof of the vehicle, so as to allow access to the weapon system from the inside of the vehicle;
- the vehicle is an armored vehicle with an armored cap;
- the armored vehicle is a stealth, tactical, light military vehicle, having an outer appearance of the 4×4, SUV or buggy type.

The present invention relates to a generally armored vehicle with a retractable weapon system, the vehicle being designed so that the weapon system is completely hidden in the upper part of the shell of the vehicle when it is in the retracted position so that the weaponry is not visible for a person located outside the vehicle. In particular, the weapon system 4 comprises at least one weapon with an ammunition caliber of up to 25-30 mm or a grenade launcher (40 mm caliber).

According to one embodiment of the invention, the vehicle 1 with the weapon system 4 in the retracted position is shown in FIGS. 1, 2, 5, 7 and 8. Furthermore, the vehicle with the weapon system 4 in the deployed position is shown in FIGS. 3, 4, 6, 9 and 10.

Figure 5:
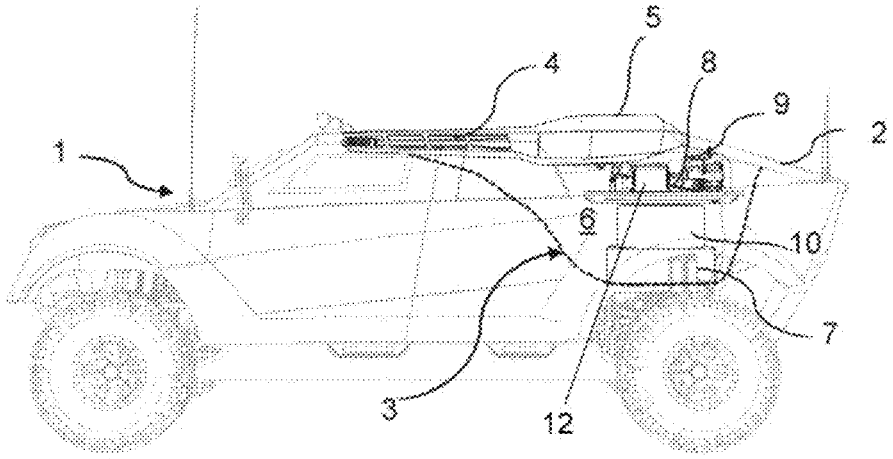
FIG. 5 schematically shows a cross-sectional view of the roof of the vehicle with the weapon system in the retracted position.
Figure 6:
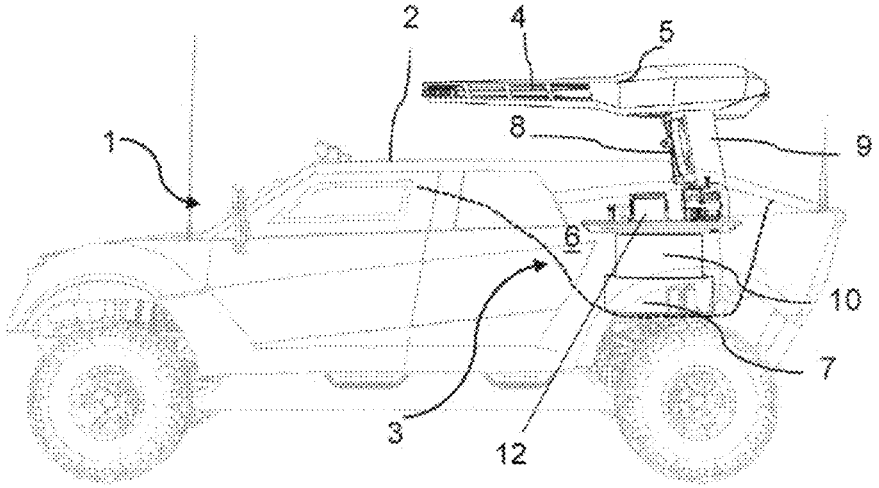
FIG. 6 schematically shows a cross-sectional view of the roof of the vehicle with the weapon system in the deployed position.
Figure 7:
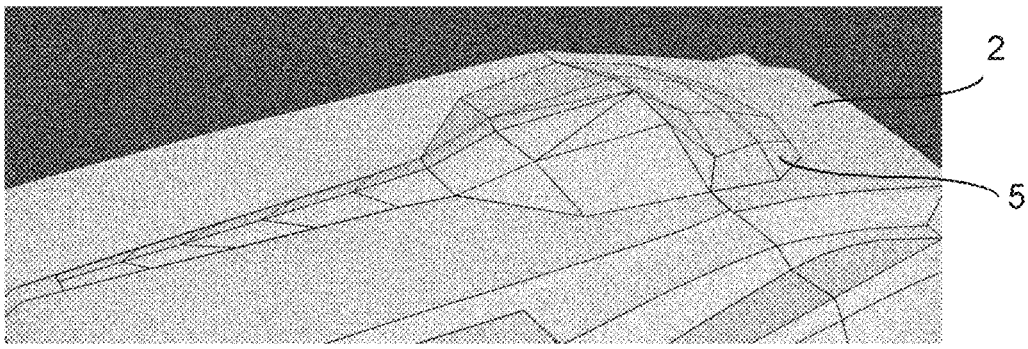
FIGS. 7 and 8 schematically show three-dimensional views of the roof of the vehicle with the weapon system in the retracted position.

The vehicle 1 according to the invention comprises a roof 2 and has a recess 3 in line with the roof 2 as shown in FIGS. 5 and 6. This recess 3 advantageously comprises a platform or a pedestal making it possible to accommodate the weapon system 4. An automated mechanism 8, for example a jack, ensures the movement of the weapon system 4 between two positions. The first position corresponds to that where the weapon system 4 is retracted and folded in the recess 3 of the roof. The second position corresponds to that where the weapon system 4 is deployed outside the recess 3 of the roof 2 and is ready to shoot. The automated mechanism 8 allows quick and easy placement of the weapon system 4 in the deployed position so as to be operational typically in less than 5 seconds.

Figure 8:
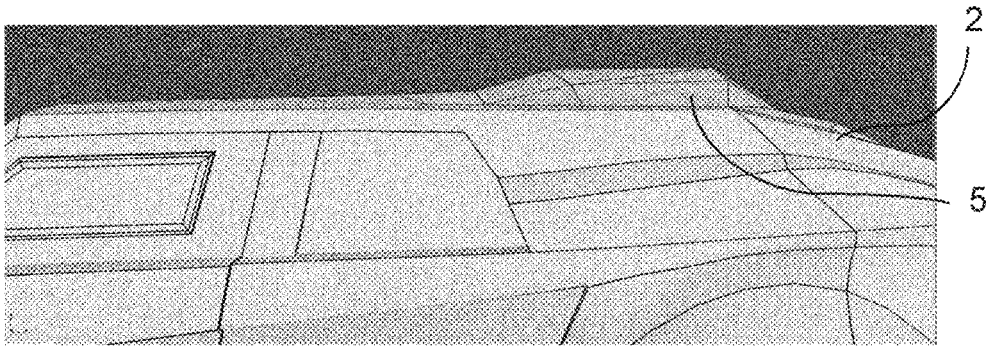
Figure 9:
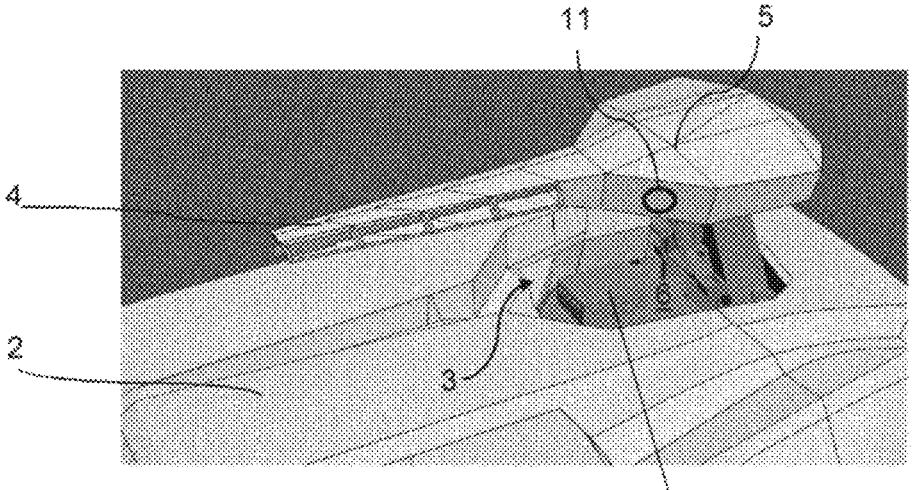
FIGS. 9 and 10 schematically show three-dimensional views of the roof of the vehicle with the weapon system in the operational deployed position.
Figure 10:
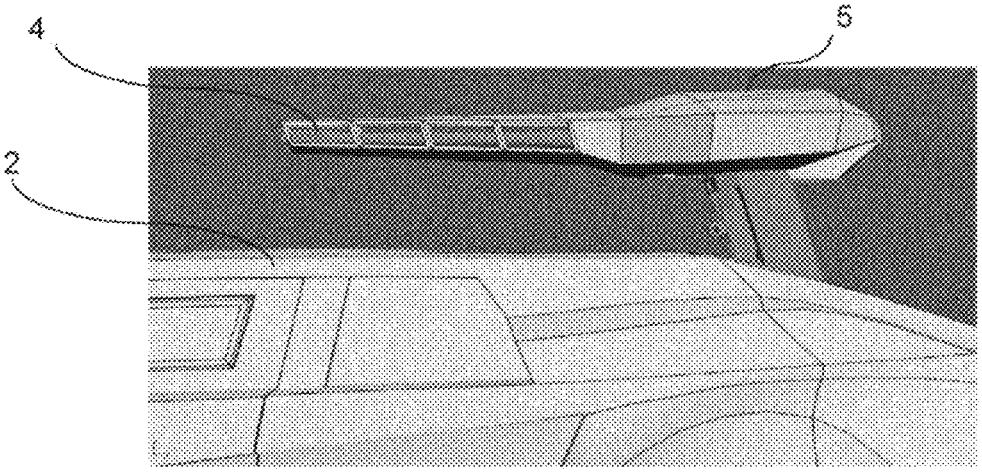

As illustrated in FIGS. 5 and 6, a potentially armored protective cap 5 covers the recess 3 when the weapon system 4 is in the first position, namely the retracted position. In this way, the roof 2 is completely closed on the recess 3 comprising the weapon and is therefore no longer visible. In order to optimize the system and so that it is as discreet as possible, the recess 3 is fitted or related exactly to the dimensions of the weapon 4, as illustrated by FIGS. 8 to 10. The surface of the cap 5 is therefore substantially identical to the surface of the recess in the roof 2, said surface of the recess being considered at the outer level and in the extension of the roof. The weapon system 4 therefore fits perfectly in the recess 3 of the roof, and the cap 5 is fitted as well as possible to the dimensions of the weapon so as to have the attached surfaces smallest possible. The cap 5 and the recess 3 therefore have optimized dimensions and geometries, as a function of the dimensions of the weapon. The armoring of the recess 3 is advantageously limited to the survival cell of the crew and/or the recharging zone of the weapon.

The cap 5 is secured to the weapon system 4, as shown in FIGS. 5 and 6, such that it moves with the weapon system when it goes from one position to the other. The generally armored cap 5 perfectly covers the recess 3 when the weapon system 4 is in the first retracted position, ensuring the continuity of the surface of the roof 2, and is raised with the weapon system 4 when the latter is in the second deployed position, ensuring protection with respect to projectiles that may optionally come from above. According to one embodiment, this armored cap 5 can optionally assume the form of a shell completely surrounding the weapon, as also illustrated by FIGS. 9 and 10.

Figure 4:
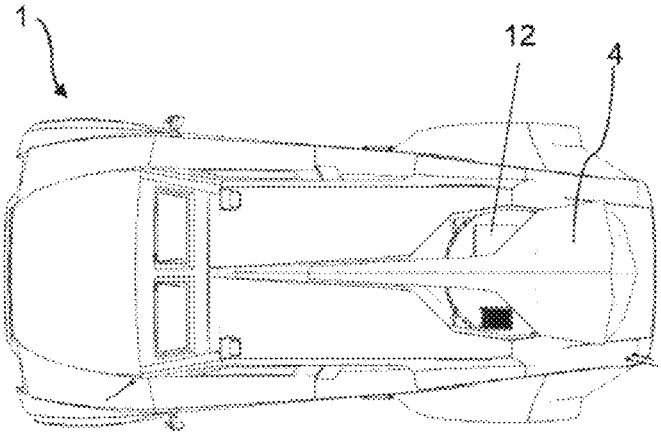
FIG. 4 schematically shows a top view of the vehicle with the weapon system in the operational deployed position.

According to one specific embodiment, the weapon system 4 can be hinged using hinged arms or a pantograph. In this way, when it is deployed, it can be off-centered relative to the recess 3 provided in the roof, as illustrated in FIG. 4.

Advantageously, the weapon system 4 comprises an integrated optic 11, for example positioned laterally relative to the weapon.

When the cap 5 covers the recess 3 while the weapon system is in the first position, a tight space 6 is advantageously created between the recess of the roof and the armored cap, in order to close the roof on the weapon system 4. Still advantageously, sealing gaskets provide the tightness of the tight space 6 when the weapon system (4) is in the first position.

Advantageously, the vehicle 1 can also comprise one or two ammunition supply rails ("feeders") 12 located below the recess 3 of the vehicle in order to be able to supply the weapon system from inside the vehicle 1. The weapon system is installed on a weapon support 9, the weapon system 4 being connected via said weapon support 9 to a shaft or rolling bearing 10. The weapon support 9 can therefore pivot by 360° about a vertical axis.

The vehicle further advantageously comprises an inner hatch 7 made below the roof 2 of the vehicle, level with the recess 3 so as to have access to the weapon system from inside the vehicle 1.

Lastly, the entire mechanism itself can be integrated into a rotary basket comprising the weapon and its mounting, which are retractable, the embedded electronics, and the feeders.

The weapon system is completely concealed in the recess of the roof when it is in the retracted position, so that such a system is unsuspected by a person located outside the vehicle. As a result, the vehicle looks like a standard vehicle, ideally of the civilian type, such as a buggy, a 4×4, an SUV, etc., without weaponry. Furthermore, the weapon is protected by the armored cap when it is retracted in the recess of the roof.

The operating time is greatly reduced, in the order of several seconds, and preferably, the weapon system is operational in less than 5 seconds. In addition to being fast, the automatic setup is secure and easy, and only requires one person.

The retractable weapon system of the vehicle according to the invention is advantageously compact and can be reloaded from the inside of the vehicle. Furthermore, the weapon is accessible from the inside of the vehicle owing to the inner hatch.

Additionally, the present invention aims to produce a vehicle whose roof is tight with respect to the outside environment when the weapon system is folded in the passenger compartment. Furthermore, the vehicle retains its aerodynamics and the weapon system is not bothersome when it is not deployed, which makes it possible to travel at normal to high speeds when the weapon is folded in the passenger compartment.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS (1) Vehicle
(2) roof of the vehicle
(3) recess in the roof of the vehicle
(4) weapon system (5) armored cap
(6) tight area containing the weapon system
(7) inner access hatch to the weapon system
(8) retractable mechanism for moving the weapon system
(9) weapon support
(10) shaft of the weapon support
(11) integrated optic
(12) ammunition supply rail

The invention claimed is:

1. An armored land vehicle, comprising:

a roof delimited by an opening containing a recess;

a retractable weapon system configured to be deployed automatically between a first retracted position located inside the vehicle in the recess of the roof and a second deployed and operational position located outside the vehicle;

an automatic mechanism configured to ensure, during use, a movement of the weapon system between the first and second positions;

an armored cap secured to the weapon system configured to cover the recess by forming a junction between an outer contour of the armored cap and a periphery of the opening of the roof with a perfect fit and as an extension of the roof surface, when the weapon system is in the first position; and an ammunition supply rail located within the recess of the roof so as to supply the weapon system from inside the vehicle, the rail remaining within the recess in both the first and second positions of the weapons system, wherein the weapon system comprises at least one weapon with a caliber of up to 40 mm, the at least one weapon comprising a barrel, such that, in the first position, the barrel is positioned forward with respect to the vehicle and a width of the at least one weapon is larger at a back of the at least one weapon than at a front of the at least one weapon, wherein the opening containing the recess is fitted or related to dimensions of the weapon system and the armored cap, the armored cap being adapted to the dimensions of the weapon system so as to have a smallest possible surface area, the armored cap having a width larger at a back thereof than at a front thereof with respect to the vehicle, the armored cap being perfectly inserted into a remainder of the roof without overlap in the first position so as to ensure continuity of the roof surface, wherein the weapon system is installed on a weapon support, the weapon support being mounted pivotably with the weapon system by a rolling bearing, wherein the weapon support is mounted so as to be pivotable 360° about a vertical axis, wherein a closing of the recess by the armored cap creates a sealed space containing the weapon system, the sealed space being ensured by at least one seal, and wherein the armored cap comprises a protective shell completely surrounding at least a part of the weapon system.

2. The armored land vehicle of claim 1, wherein the armored cap completely covers the recess in an upper part of a shell of the vehicle.

3. The armored land vehicle of claim 1, wherein the armored cap covers only an upper part of the weapon system.

4. The armored land vehicle of claim 1, wherein the automatic mechanism comprises at least one jack.

5. The armored land vehicle of claim 1, further comprising:

an inner hatch below the recess of the roof so as to allow access to the weapon system from inside the vehicle.

6. The armored land vehicle of claim 1, wherein the armored land vehicle comprises a military vehicle.

* * * * *